US005408581A

United States Patent [19]

Suzuki et al.

[11] Patent Number: 5,408,581

[45] Date of Patent: Apr. 18, 1995

[54] APPARATUS AND METHOD FOR SPEECH SIGNAL PROCESSING

[75] Inventors: Ryoji Suzuki, Nara; Yoshiyuki Yoshizumi, Suita; Tsuyoshi Mekata, Katano; Yoshinori Yamada, Katano; Masayuki Misaki, Kobe, all of Japan

[73] Assignee: Technology Research Association of Medical and Welfare Apparatus, Tokyo, Japan

[21] Appl. No.: 849,575

[22] Filed: Mar. 10, 1992

[30] Foreign Application Priority Data

| | | | |
|---|---|---|---|
| Mar. 14, 1991 | [JP] | Japan | 3-075693 |
| Sep. 30, 1991 | [JP] | Japan | 3-270761 |
| Mar. 2, 1992 | [JP] | Japan | 4-081670 |

[51] Int. Cl.[6] ..... G10L 9/00

[52] U.S. Cl. ..... 395/2.35; 381/46; 364/724.12; 364/724.16

[58] Field of Search ..... 395/2.35, 2.36, 2.37, 395/2.8, 2.4, 2.42; 381/68.4, 46; 364/724.01, 724.12, 724.16, 728.01

[56] References Cited

U.S. PATENT DOCUMENTS

| | | | |
|---|---|---|---|
| 4,426,729 | 1/1984 | Gritton | 395/2.4 |
| 4,508,940 | 4/1985 | Steeger | 381/68.4 |
| 4,982,341 | 1/1991 | Laurent | 381/46 |
| 5,230,060 | 7/1993 | Naitoh | 395/2.35 |
| 5,278,910 | 1/1994 | Suzuki et al. | 395/2.4 |

OTHER PUBLICATIONS

"Consonant Burst Enhancement: A Possible Means to Improve Intelligibility for the Hard of Hearing", R. W. Guelke, Journal of Rehabilitation Research and Development, vol. 24, No. 4, pp. 217–220, Fall 1987.

*Primary Examiner*—Allen R. MacDonald
*Assistant Examiner*—Michael A. Sartori
*Attorney, Agent, or Firm*—Wenderoth, Lind & Ponack

[57] ABSTRACT

In an apparatus for speech signal processing, first a coefficient calculation is performed to determine a value for suppressing a change of level of an input signal. Next, an input signal delay is performed to delay the input signal by a time required for the coefficient calculation. Then an output of the input signal delay is multiplied by the value obtained by the coefficient calculation, thereby obtaining an output signal.

30 Claims, 13 Drawing Sheets

APPARATUS AND METHOD FOR SPEECH SIGNAL PROCESSING

BACKGROUND OF THE INVENTION

1. Field of the Invention

The present invention relates to apparatus and method for speech signal processing for improving the intelligibility of a speech signal in a hearing aid or a public address system.

2. Description of the Prior Art

A speech signal making apparatus for processing a speech easier to perceive for the hard of hearing has been hitherto studied, and an example was disclosed by R. W. Guelke in "Consonant burst enhancement: A possible means to improve intelligibility for the hard of hearing," Journal of Rehabilitation Research and Development, Vol. 24, No. 4, fall 1987, pages 217–220.

In such a conventional apparatus for speech signal processing, first the input signal is entered into a gap detector, an envelope follower and a zero crossing detector. Next the gap detector, envelope follower, dlfferentiator, and zero crossing detector detect the burst of a stop consonant. Then a one-shot multivibrator produces pulses in a specific interval corresponding to the burst to an amplifier. Finally, the amplifier amplifies the input signal for the interval length of pulses produced by the one-shop multivibrator at a specific amplification factor.

In such a conventional constitution, it is difficult to detect the burst of a stop consonant, and it is particularly hard if noise is superposed. Further, only the stop consonant can be enhanced, and many other consonants cannot be emphasized. Yet, since the amplifying interval and amplification factor are constant, It is not possible to follow up changes.

Also hitherto, an apparatus and method for speech signal processing for making speech easier to perceive for the hard of hearing have been studied, and the present inventors previously disclosed an example in "Apparatus and method for speech signal processing." U.S. application Ser. No. 748,190, filed Aug. 20, 1991, now U.S. Pat. No. 5,278,910.

In such a speech signal processing apparatus, first the level measuring means measures the level of the input signal, and the coefficient calculating means finds the value, on the basis of the output of the level measuring means, which becomes a large value when the level of the input signal at a specific time is smaller than the levels before and after in time, and becomes a small value when larger than the levels before and after in time, then the output of the input signal delay means for delaying the input signal for compensating for the delay of processing and the output of the coefficient calculating means are multiplied by first multiplying means and produced.

In such a constitution, as the coefficient calculating means determines the value for suppressing the change of the level of the input signal on the basis of the level of the input signal determined by the level measuring means, a large memory capacity is required, and the hardware load increases and the processing delay is prolonged at the same time, and the response speed of the value for suppressing the level changes is delayed, and consonants may not be enhanced sufficiently. Furthermore, if the output of the coefficient calculating means is directly used, not only are the consonants is enhanced, but also the vowels are suppressed, whereby a natural sounding speech is not obtained.

SUMMARY OF THE INVENTION

It is hence a primary object of the invention to present an apparatus and method for speech signal processing capable of improving the intelligibility of speech stably without spoiling the natural sound of the speech using a relatively simple processing.

To achieve the above object, an apparatus for speech signal processing of the invention comprises coefficient calculating means for determining a value for suppressing a change of level of an input signal, input signal delay means for delaying the input signal to compensate for a processing delay, and first multiplying means for multiplying an output of the input signal delay means by an output of the coefficient calculating means.

In this constitution, by multiplying the output of the input signal delay means and the output of the coefficient calculating means by the first multiplying means, the time-course changes of the level of the input signal are reduced, and temporal masking is avoided. Therefore, masking of a signal of a small level such as a consonant by the signal of a large level such as a vowel may be avoided, and the intelligibility is hence improved in a simple constitution.

The coefficient counting means comprises absolute value means for determining an absolute value of the input signal, absolute value delay means for storing an output of the absolute value means and simultaneously delaying the stored value, first memory means for storing coefficient values for calculating the value for suppressing the change of level of the input signal, second memory means for storing coefficient values for calculating the level of the input signal, first convolutional operating means for performing a convolutional operation of a content of the absolute value delay means and a content of the first memory means, second convolutional operating means for performing a convolutional operation of a content of the absolute value delay means and a content of the second memory means, and dividing means for dividing an output of the first convolutional operating means by an output of the second convolutional operating means.

In this constitution, in which the memory content of the first memory means is characterized by differentiating in two steps the level of the input signal with respect to the time axis, and the memory content of the second memory means is integrated with respect to the time axis, the value for smoothing the level of the input signal may be easily obtained. Furthermore, the coefficient calculating means produces a value corresponding to the change of level of the input signal, and therefore the stationary noise in the silent section is not amplified.

DESCRIPTION OF THE PREFERRED EMBODIMENTS

Figure 1:
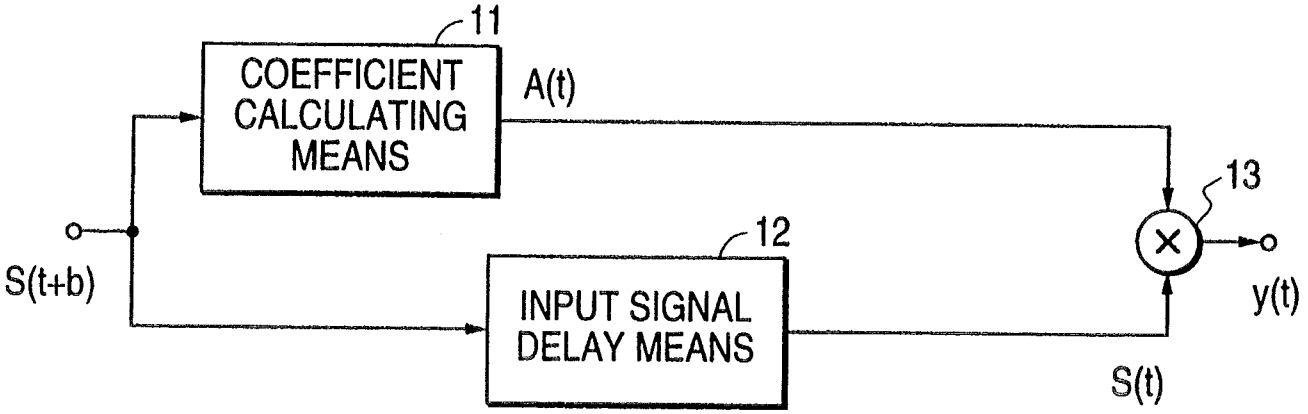
FIG. 1 is a structural diagram of an apparatus for speech signal processing in an embodiment of the invention.

FIG. 1 shows the constitution of an apparatus for speech signal processing in an embodiment of the invention. In FIG. 1, numeral 11 is coefficient calculating means, 12 is input signal delay means, and 13 is first multiplying means.

The operation of the thus constituted apparatus for speech signal processing is described below.

First the coefficient calculating means 11 and input signal delay means 12 receive an input signal s(t+b). The coefficient calculating means 11 determines a value A(t) for suppressing the change of level of the input signal s(t) on the basis of the input signals at that time t and the time before and after it. The input signal delay means 12 delays the input signal by the time b necessary for processing. The first multiplying means 13 multiplies and produces the output s(t) of the input signal delay means 12 and the output A(t) of the coefficient calculating means 11. Then the input signal delay means 12 delays the entire stored content by one sample each.

Figure 2:
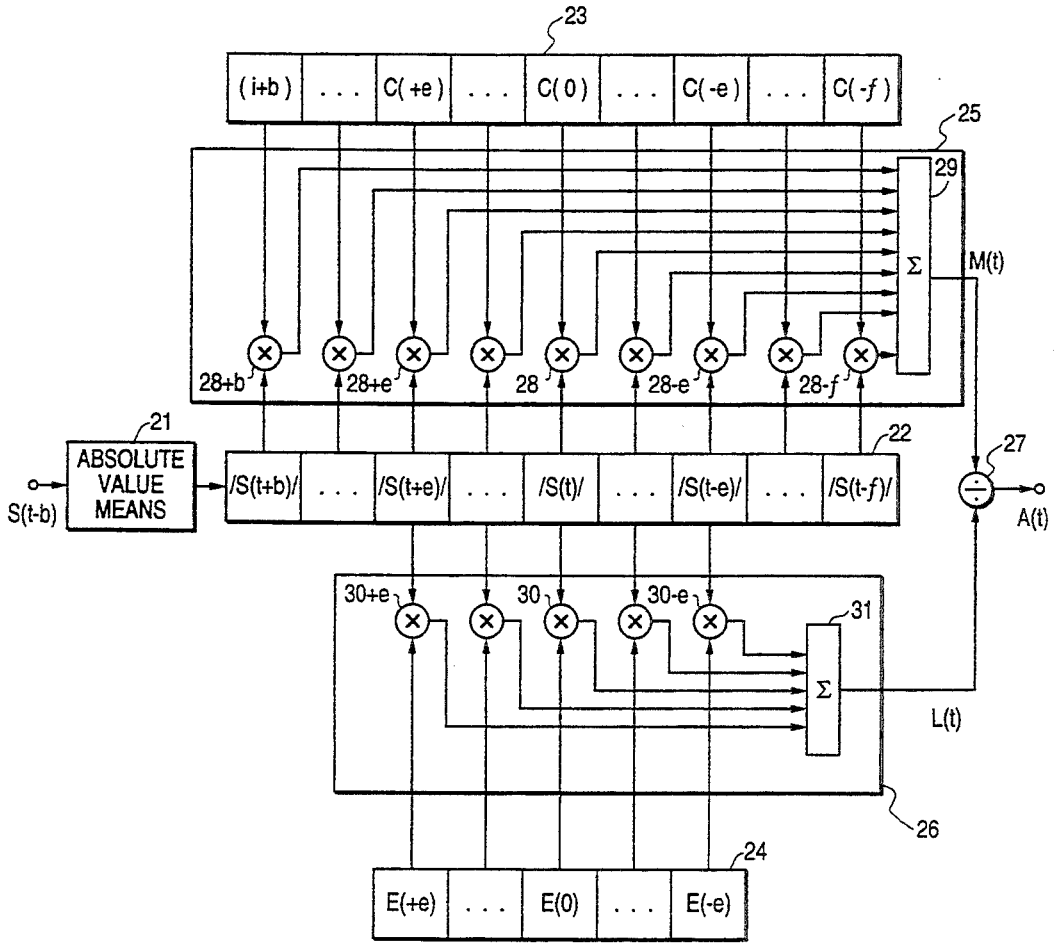
FIG. 2 is a structural diagram of coefficient calculating means of the apparatus for speech signal processing in the embodiment of the invention.

FIG. 2 shows the constitution of the coefficient calculating means 11 of the apparatus for speech signal processing in the embodiment of the invention. In FIG. 2, numeral 21 is absolute value means, 22 is absolute value delay means, 23 is first memory means for storing the coefficient for calculating the value for suppressing the change of level of the input signal, 24 is second memory means for storing the coefficient for calculating the level of the input signal, 25 is first convolutional operating means, 26 is second convolutional operating means, 27 is dividing means, 28+b to 28−f are multiplying means, 29 is summing means, 30+3 to 30−e are multiplying means, and 31 is summing means.

The operation of the thus constituted coefficient calculating means of the apparatus for speech signal processing is described below.

First the absolute value means 21 determines the absolute value of the input signal s(t+b), and outputs the absolute value to the absolute value delay means 22. The absolute value delay means 22 stores the outputs of the absolute value means 21 at the time t and the time before and after it (|s(t+b)| to |s(t−f)|). The first convolutional operating means 25 performs a convolutional operation of the content of the absolute value delay means 22 (|s(t+b)| to |s(t−f)|) and the content of the first memory means 23 (C(c+b) to C(−f)) by using the multiplying means 28+b to 28−f and the summing means 29, and finds the value M(t) for suppressing the change of level of the input signal before it is normalized by the level. The second convolutional operating means 22 performs a convolutional operation of the content of the absolute value delay means 22 (|s(t+e)| to |s(t−e)|) and the content of the second memory means 24 (E(+e) to E(−e)) by using the multiplying means 30+b to 30−f and the summing means 31, thereby determining the level L(t) of the input signal at time t. The dividing means 27 divides the output M(t) of the first convolutional operating means 25 by the output L(t) of the second convolutional operating means 26, and produces the value A(t) for suppressing the change of level of the input signal. Finally the entire content in the absolute value delay means 22 is delayed by one sample each.

Figure 3:
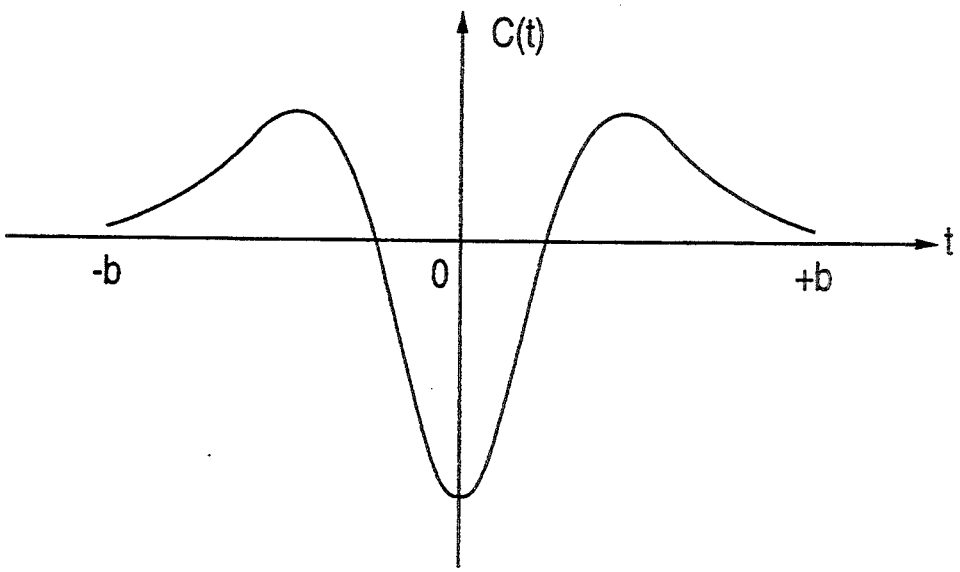
FIG. 3 is a characteristic diagram of content C(t) of first memory means of the apparatus for speech signal processing in the embodiment of the invention.

FIG. 3 shows the characteristic of the coefficient C(t) stored in the first memory means for calculating the value M(t) for suppressing the level change of the input signal. This coefficient C(t) is shown in equation (1). As shown in equation (3), by convolving this coefficient C(t) into the absolute value of the input signal s(t), the value of M(t) becomes large when the level before and after the time t is larger than the level at the time t, and the value of M(t) becomes small when the level before and after the time t is smaller than the level at the time t, and therefore by multiplying M(t) by the input signal, the level of the input signal is smoothed. That is, the coefficient C(t) has a characteristic for differentiating in two steps with respect to the time axis. However, the coefficient C(t) is set so as to satisfy the condition of equation (2) in order not to change the entire level.

$$C(t)=k_{\cdot}\exp(-t^2/2\sigma_{\cdot}^2)-k_i\exp(-t^2/2\sigma_i^2) \quad (1)$$

where $k_{\cdot}<k_i$, $\sigma_{\cdot}>\sigma_i$ $$\sum_{i=+b}^{-b} C(i) = 1 \quad (2)$$

$$M(t) = \sum_{i=+b}^{-b} C(i) \cdot |s(t+i)| \quad (3)$$

Figure 4:
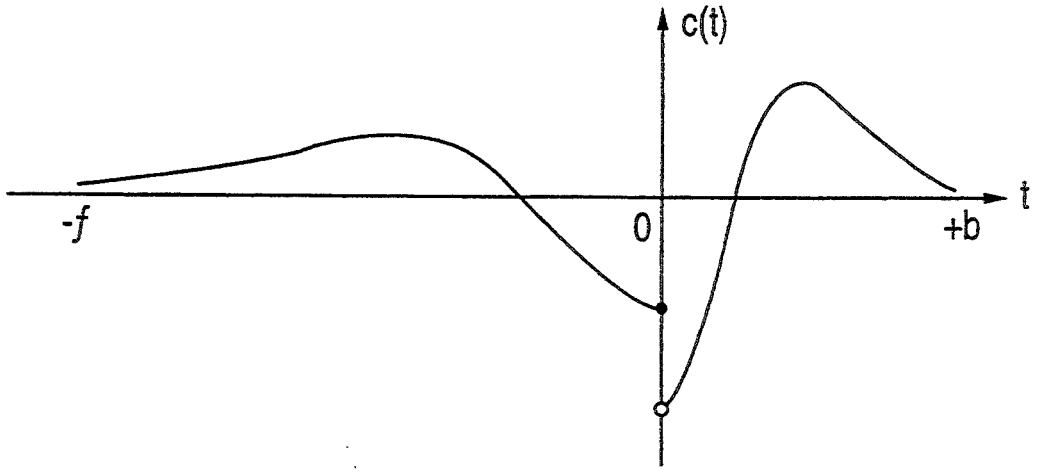
FIG. 4 is another characteristic diagram of content C(t) of first memory means of the apparatus for speech signal processing in the embodiment of the invention.

FIG. 4 shows another characteristic of the coefficient C(t) stored in the first memory means in order to calculate the value M(t) for suppressing the level change of the input signal. This coefficient is shown in equation (4). As shown in this diagram, by making the coefficient C(t) asymmetrical with respect to the time axis, the temporal masking of auditory sense is securely compensated. As shown in equation (6), by convolving this coefficient C(t) into the absolute value of the input signal s(t), the value of M(t) becomes large when the level before and after the time t is larger than the level at the time t, and the value of M(t) becomes small when the level before and after the time t is smaller than the level at the time t, and therefore by multiplying M(t) and the input signal, the level of the input signal is smoothed. That is, the coefficient C(t) is has a characteristic for differentiating in two steps with respect to the time axis. However, the coefficient C(t) is set so as to satisfy the condition of equation (5) in order not to change the entire level.

$$C(t)=k_{ef}\exp(-t^2/2\sigma_{ef}^2)-k_{if}\exp(-t^2/2\sigma_{if}^2) \qquad t\leqq 0$$

$$C(t)=k_{eb}\exp(-t^2/2\sigma_{eb}^2)-k_{ib}\exp(-t^2/2\sigma_{ib}^2) \qquad t>0$$

where $$k_{ef}<k_{if},\ \sigma_{ef}>\sigma_{if}$$

$$k_{eb}<k_{ib},\ \sigma_{eb}>\sigma_{ib}$$

$$k_{ef}<k_{eb},\ k_{if}<k_{ib}$$

$$\sigma_{ef}>\sigma_{eb},\ \sigma_{if}>\sigma_{ib} \quad (4)$$

$$\sum_{i=+b}^{-f} C(i) = 1 \quad (5)$$

$$M(t) = \sum_{i=+b}^{-f} C(i) \cdot |s(t+i)| \quad (6)$$

Figure 5:
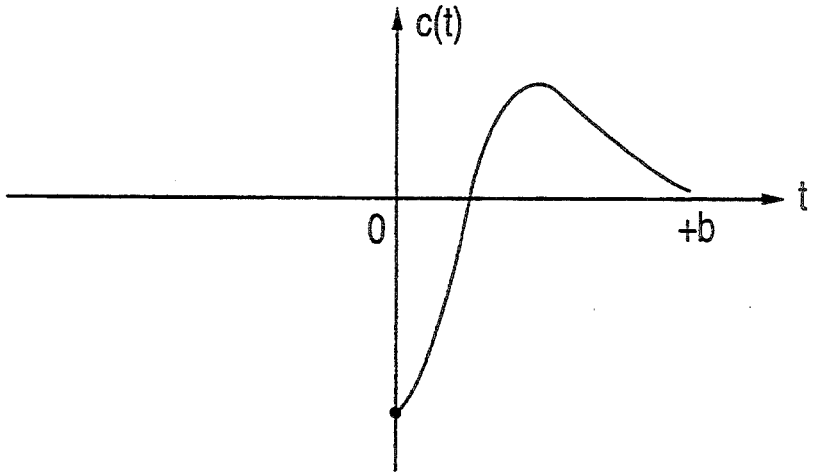
FIG. 5 is a different characteristic diagram of content C(t) of first memory means of the apparatus for speech signal processing in the embodiment.

FIG. 5 shows another characteristic of the coefficient C(t) stored in the first memory means for calculating the value M(t) for suppressing the level change of input signal. This coefficient C(t) is shown in equation (7). As known from this diagram, by limiting the coefficient C(t) only to the positive time axis, the amplification in the silent sectional after a vowel is decreased and the quantity of calculations is smaller. As shown in equation (9), by convolving this coefficient C(t) into the absolute value of the input signal s(t), the value of M(t) becomes large when the level after the time t is larger than the level at the time t, and the value of M(t) becomes small when the level after the time t is smaller than the level at the time t, and therefore by multiplying M(t) and input signal, the level of the input signal is smoothed. That is, the coefficient C(t) has a characteristic of differentiating the rise of the input signal in two steps with respect to the time axis. However, the coefficient C(t) is set so as to satisfy the condition in equation (8) in order not to change the entire level.

$$C(t)=k_e\exp(-t^2/2\sigma_e^2)-k_i\exp(-t^2/2\sigma_i^2) \quad (7)$$

where $k_e<k_i$, $\sigma_e>\sigma_i$, $t\leqq 0$ $$\sum_{i=+b}^{\phi} C(i) = 1 \quad (8)$$

$$M(t) = \sum_{i=+b}^{\phi} C(i) \cdot |s(t+i)| \quad (9)$$

Figure 6:
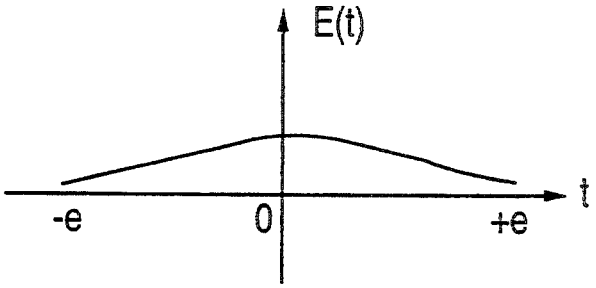
FIG. 6 is a characteristic diagram of content E(t) of second memory means of the apparatus for speech signal processing in the embodiment of the invention.

FIG. 6 shows the characteristic of the coefficient E(t) stored in the second memory means for determining the level of the input signal. This coefficient E(t) is shown in equation (10). As shown in equation (12), by convolving this coefficient E(t) into the absolute value of input signal, the absolute value of the input signal is smoothed, and the level of the input signal may be determined. That is, the coefficient E(t) has a characteristic for integrating on the time axis. However, in order not to change the entire level the coefficient E(t) is set so as to satisfy the condition of equation (11).

$$E(t)=k_n\exp(-t^2/2\sigma_n^2) \quad (10)$$

$$\sum_{i=+e}^{-e} E(i) = 1 \quad (11)$$

$$L(t) = \sum_{i=+e}^{-e} E(i) \cdot |s(t+i)| \quad (12)$$

Figure 7A:
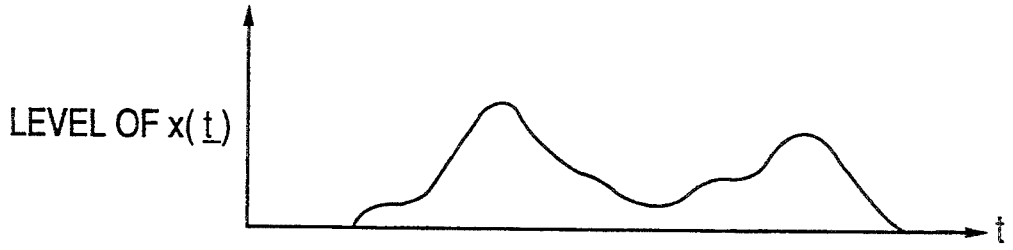
FIG. 7 is an example of the level of an input signal and the level of an output signal of the apparatus for speech signal processing in the embodiment of the invention.
Figure 7B:
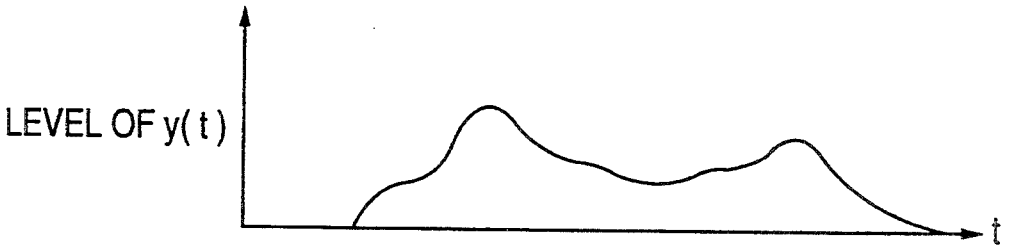

FIG. 7 shows the result of processing by the apparatus for speech signal processing in the embodiment of the invention, where FIG. 7(*a*) denotes the level of the input signal s(t), and FIG. 7(*b*) represents the level of the output signal y(t). As shown in this diagram, as compared with the input, the level change of the output is suppressed.

Thus, according to this embodiment, the coefficient calculating means 11 determines the value A(t) for suppressing the level change of the input signal on the basis of the input signals at that time and the time before and after it, and the first multiplying means 13 multiplies and produces the output s(t) of the input signal delay means 12 and the output A(t) of the coefficient calculating means 11, and therefore the level change is suppressed in the output signal as compared with the input signal, which prevents the signal of a small level such as a consonant from being masked by a signal of a larger level such as a vowel, thereby improving the intelligibility. Further, the coefficient calculating means 11 produces the value A(t) corresponding to the level change of the input signal, and the stationary noise in the silent section is not amplified, and the first memory means 23 stores the coefficient C(t) indicated in equation (1), equation (4) or equation (7), while the second memory means 24 stores the coefficient E(t) indicated in equation (10) in the condition of equation (11), and the first convolutional operating means 25 performs convolutional operation of the content of the absolute value delay means 22 and the content of the first memory means 23 to find M(t), while the second convolutional operating means 26 performs convolutional operation of the content of the absolute value delay means 22 and the content of the second memory means 24 to find L(t), then the dividing means 27 divides the output M(t) of the first convolutional operating means 25 by the output L(t) of the second convolutional operating means 26, so that M(t) becomes the value A(t) normalized at the level of the input signal, and the value of this A(t) becomes large when the level before and after the time t is larger than the level at the time t, and the value becomes small when the level before and after the time t is smaller than the level at the time t, thereby easily obtaining the value A(t) which can stably suppress the level change of the input signal. Here, when the first memory means 23 stores the coefficient C(t) indicated in equation (14), the temporal masking of the auditory sense is compensated more securely. Or, at this time, when the first memory means 23 stores the coefficient C(t) indicated in equation (17), the amplification of the silent section after the vowel is decreased and the quantity of calculations is smaller.

Figure 8:
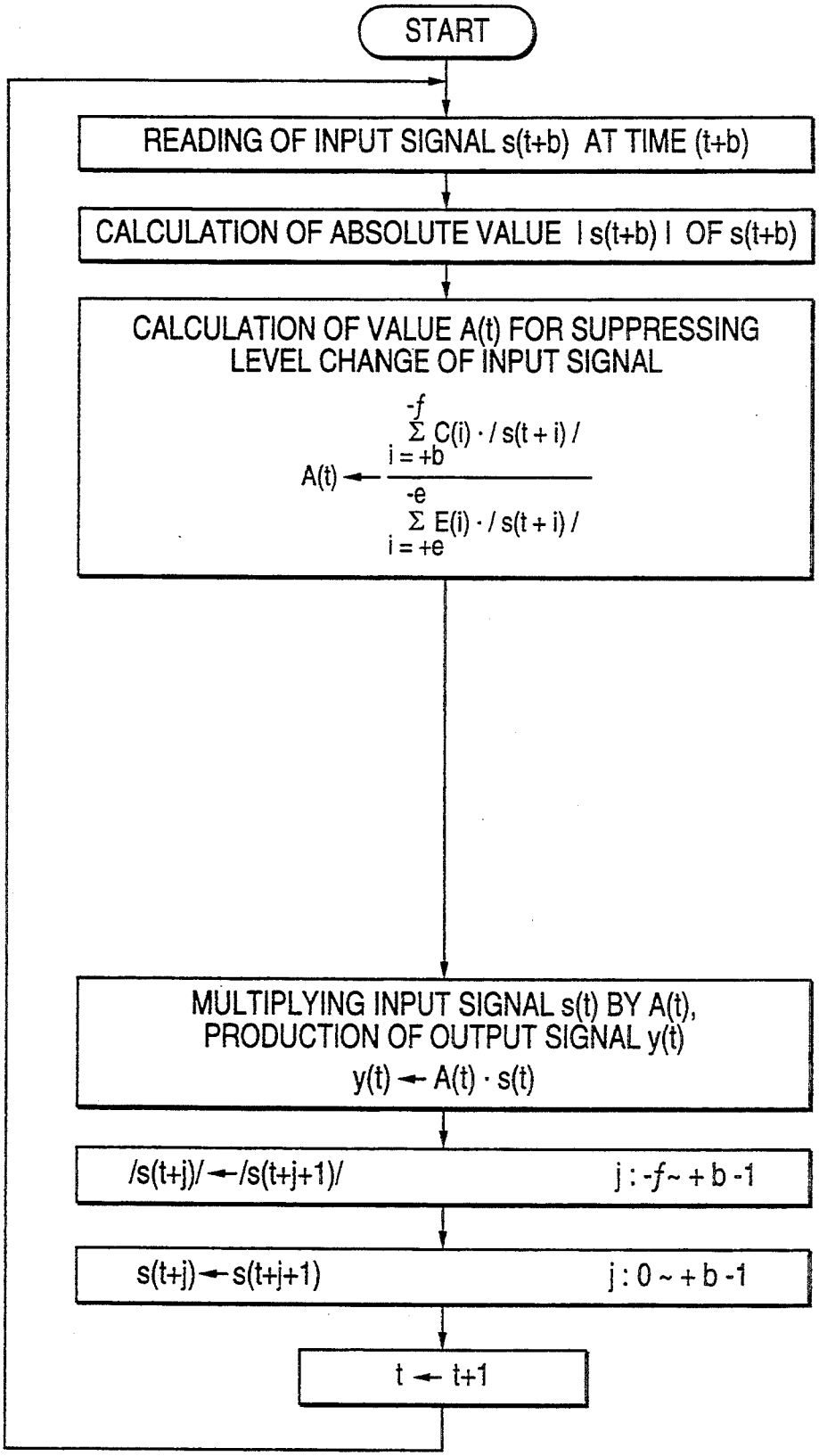
FIG. 8 is a flow chart of a method for speech signal processing in the embodiment of the invention.

FIG. 8 shows a flow chart of a method for speech signal processing in the embodiment of the invention.

Its operation is described below.

First the input signal s(t+b) at time t+b is read in. Next, the absolute value |s(t+b)| of the input signal s(t+b) is determined. According to equation (13), equation (14) or equation (15), the value A(t) for suppressing the change of level of the input signal is determined. C(i) in equation (13) denotes what is shown in equation (1), C(i) in equation (14) is what is shown in equation (4), and C(i) in equation (14) is what is shown in equation (7), and E(i) is what is shown in equation (10).

$$A(t) = \frac{\sum_{i=+b}^{-b} C(i) \cdot |s(t+i)|}{\sum_{i=+e}^{-e} E(i) \cdot |s(t+i)|} \tag{13}$$

$$A(t) = \frac{\sum_{i=+b}^{-f} C(i) \cdot |s(t+i)|}{\sum_{i=+e}^{-e} E(i) \cdot |s(t+i)|} \tag{14}$$

$$A(t) = \frac{\sum_{i=+b}^{o} C(i) \cdot |s(t+i)|}{\sum_{i=+e}^{-e} E(i) \cdot |s(t+i)|} \tag{15}$$

Then, as shown in equation (16), the input signal s(t) is multiplied by A(t) to obtain output signal y(t).

$$y(t)=A(t)\cdot s(t) \tag{16}$$

The absolute value of the input signal is shifted by one sample each. The input signal is shifted by one sample each. Finally the time t is updated to return to the first processing.

Thus, according to this embodiment, by determining the absolute value of the input signal, finding the value A(t) for suppressing the change of the level of input signal in equation (13), equation (14) or equation (15) by using the absolute values of the input signals at time t and the time before and after it, and multiplying the value A(t) by the input signal s(t), the change-of level of the input signal is suppressed, and therefore the signal of a small level such as a consonant is prevented from being masked by the signal of a large level such as a vowel, and the intelligibility may be improved, and moreover the value A(t) corresponds to the change of the level of input signal, so that the stationary noise in the silent section will not be amplified.

Figure 9:
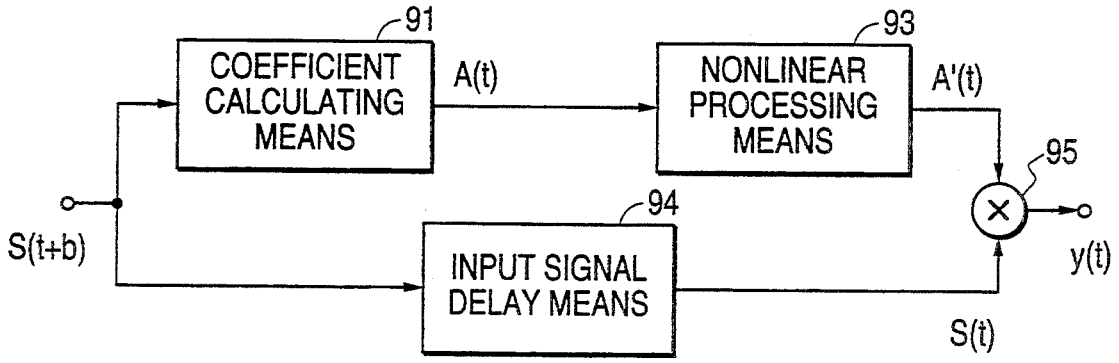
FIG. 9 is a structural diagram of an apparatus for speech signal processing in a second embodiment of the invention.

FIG. 9 shows the constitution of an apparatus for speech signal processing in a second embodiment of the invention. In FIG. 9, numeral 91 denotes coefficient calculating means, 93 is nonlinear processing means, 94 is input signal delay means, and 94 is first multiplying means. The coefficient calculating means 91 is same as that shown in FIG. 2.

The operation of the thus composed apparatus for speech signal processing is described below.

First the coefficient calculating means 91 and input signal delay means 94 receive an input signal s(t+b). The coefficient calculating means 91 finds the value A(t) for suppressing the change of level of the input signal s(t) on the basis of the input signals at that time t and the time before and after it. The nonlinear processing means 93 performs nonlinear processing on the output A(t) of the coefficient calculating means 91, and produces the value A'(t). The input signal delay means 94 delays the input signal by the time b required for processing. The first multiplying means 94 multiplies and produces the output s(t) of the input signal delay means 94 and the output A'(t) of the nonlinear processing means 93. The input signal delay means 94 delays all the stored content by one sample each.

Figure 10:
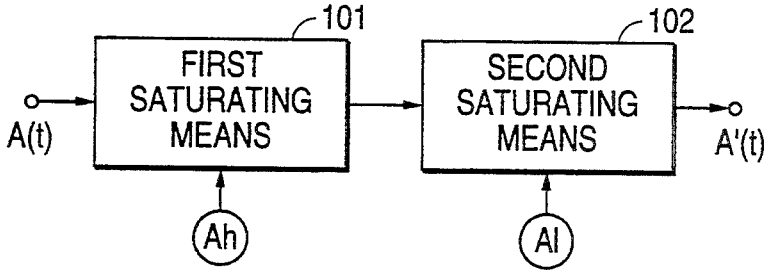
FIG. 10 is a structural diagram of nonlinear processing means of the apparatus for speech signal processing in the second embodiment of the invention.

FIG. 10 shows the constitution of the nonlinear processing means 93 of the apparatus for speech signal processing in the second embodiment of the invention. In FIG. 10, numeral 101 is first saturating means for saturating when the output value A(t) of the coefficient calculating means 91 exceeds the upper limit, and 102 is second saturating means for saturating when the value A(t) becomes lower than the lower limit.

The operation of the thus composed nonlinear processing means of the apparatus for speech signal processing is described below.

First the first saturating means 101 saturates the value A(t) to the upper limit value Ah when the output A(t) of the coefficient calculating means 91 exceeds the upper limit value Ah. The second saturating means 102, as far as the value A(t) does not exceed the lower limit value Al, saturates the value A(t) to the lower limit value Al, and delivers the value A'(t) for suppressing the change of level of the input signal.

Figure 11:
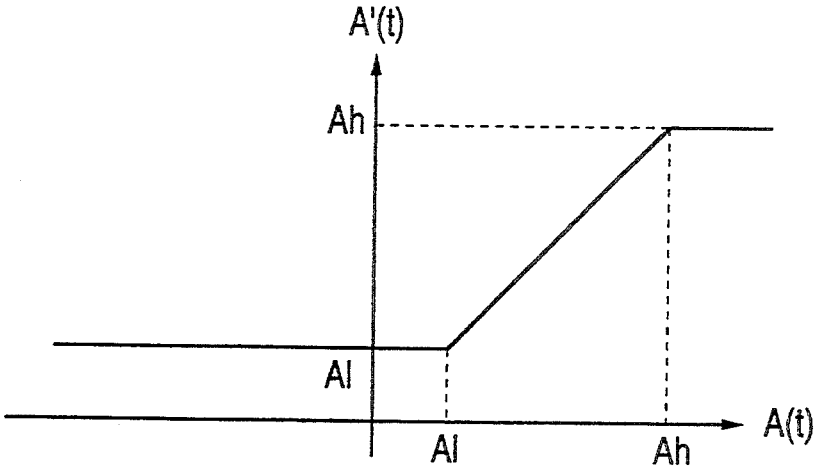
FIG. 11 is a characteristic diagram of nonlinear processing means of the apparatus for speech signal processing in the second embodiment of the invention.

FIG. 11 shows the input and output characteristic of the nonlinear processing means 93. By multiplying this value A'(t) by the input signal s(t), the level of the input signal is smoothed without being enhanced or suppressed excessively.

Figure 12:
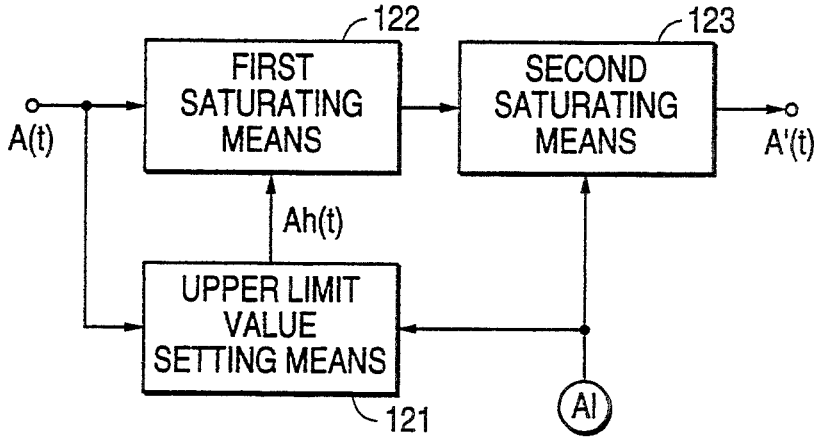
FIG. 12 is another structural diagram of nonlinear processing means of the apparatus for speech signal processing in the second embodiment of the invention.

FIG. 12 shows another constitution of the nonlinear processing means 93 of the apparatus for speech signal processing in the second embodiment of the invention. In FIG 12, numeral 121 is upper limit value setting means for producing the upper limit value, 122 is first saturating means for saturating when the output value A(t) of the coefficient calculating means 91 exceeds the upper limit, and 123 is second saturating means for saturating when the value A(t) becomes lower than the lower limit.

The operation of the thus composed nonlinear processing means of the apparatus for speech signal processing in the second embodiment of the invention, is described below.

First the upper limit value setting means 121 produces the upper limit value Ah(t) on the basis of the output value A(t) of the coefficient calculating means 91 and the lower limit value Al. The first saturating means 122 saturates the value A(t) to the upper limit value Ah(t) when the value A(t) exceeds the upper limit value Ah(t) produced by the upper limit value setting means 121. The second saturating means 123 saturates the value A(t) to the lower limit value Al when the value A(t) does not exceed the lower limit value Al, and produces the value A'(t) for suppressing the change of level of the input signal.

Figure 13:
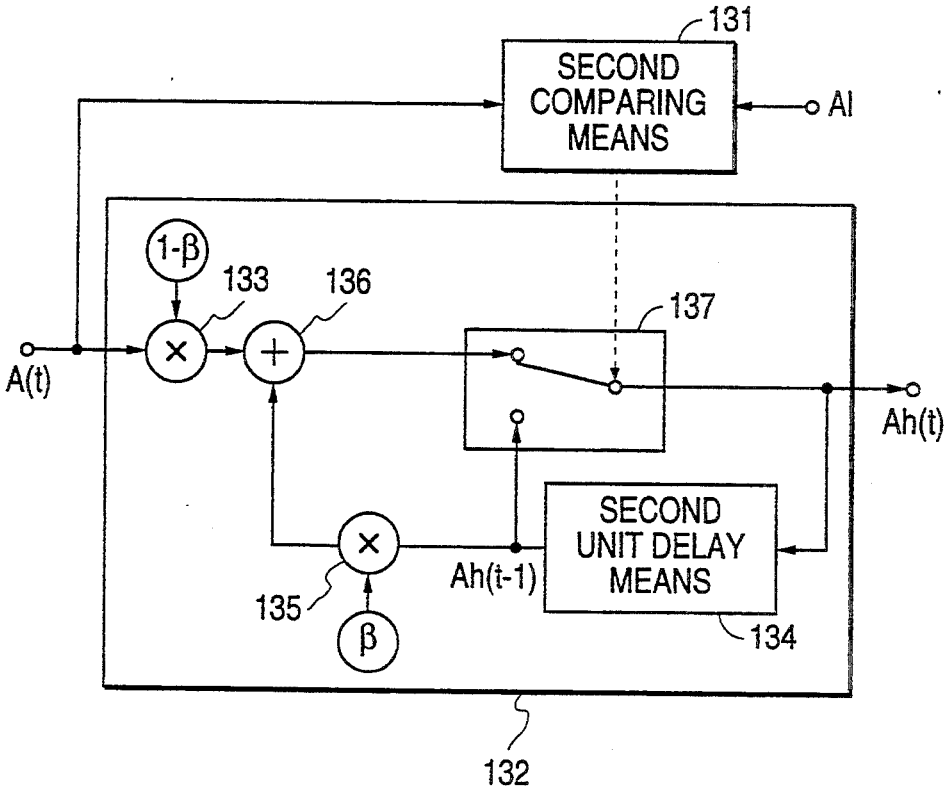
FIG. 13 is a structural diagram of upper limit value setting means of the nonlinear processing means of the apparatus for speech signal processing in the second embodiment of the invention.

FIG. 13 shows the constitution of the upper limit value setting means 121 of the apparatus for speech signal processing in the second embodiment of the invention. In FIG. 13, numeral 131 is second comparing means for comparing the output value A(t) of the coefficient calculating means 91 and the lower limit value Al, 132 is second smoothing means for smoothing the value A(t), 133 is third multiplying means for multiplying the output value A(t) of the coefficient calculating means 91 by $(1-\beta)$, 134 is second unit delay means for performing unit delay on the output of the second smoothing means 132, 135 is fourth multiplying means for multiplying the output of the second unit delay means 134 by the coefficient $\beta$ $(0 \leqq \beta \leqq 1)$, 136 is adding means for summing the output of the third multiplying means 133 and the output of the fourth multiplying means 135, and 137 is second changeover means for selecting the output of the second unit delay means 134 and the output of the adding means 136.

The operation of the thus composed upper limit setting means of the apparatus for speech signal processing is described below.

First the second comparing means 131 compares the output value A(t) of the coefficient calculating means 91 and the value Al set as the lower limit. When the second comparing means 131 judges that the output of the coefficient calculating means 91 is larger than the value Al set as the lower limit, the second comparing means 131 changes over the second changeover means 137 to the upper side, and the third multiplying means 133, second unit delay means 134, fourth multiplying means 135 and adding means 136 smooth the output value A(t) of the coefficient calculating means 91, and deliver the upper limit value Ah(t). Alternately, when the second comparing means 131 judges that the output of the coefficient calculating means 91 is smaller than the value Al set as the lower limit, the second comparing means 131 changes over the second changeover means 137 to the lower side, and the output of the second unit delay means 134 is produced as the upper limit value Ah(t) and the value is maintained.

Thus, according to this embodiment, the coefficient calculating means 91 determines the value A(t) for suppressing the change of level of the input signal on the basis of the input signals at that time and the time before and after it, and the value A'(t) after the nonlinear processing means 93 is multiplied by the output s(t) of the input signal delay means 94 by the first multiplying means 95 to produce the product, and therefore as compared with the input signal, the change of the level of output signal is suppressed, and hence the signal of a small level such as a consonant is prevented from being masked by the signal of a large level such as vowel, thereby improving the intelligibility. Further, since the coefficient calculating means 91 produces the value A(t) corresponding to the level change of the input signal, the stationary noise in the silent section is not amplified, and further the value A(t) becomes large when the level before and after the time t is larger than the level at the time t, and becomes small when the level before and after the time t is smaller than the level at the time t, so that the level change of the input signal may be easily suppressed stably. Moreover, the nonlinear processing means 93 performs nonlinear processing on the value A(t) and produces the value A'(t) defined with the upper limit and lower limit, and therefore excessive enhancement or suppression may be avoided, and therefore the speech may be enhanced while maintaining a natural sound. In addition, the upper limit value setting means 121 of the nonlinear processing means 93 smooths the output A(t) of the coefficient calculating means 91 and determines the upper limit value Ah(t) adaptively, and therefore the upper limit value Ah(t) is smaller in a noisy environment, and excessive amplification of noise is prevented, while the output A'(t) of the nonlinear processing means 93 is easily saturated at the upper limit value, and hence the stationary gain section is extended, and the naturalness of the speech is hardly spoiled.

Figure 14:
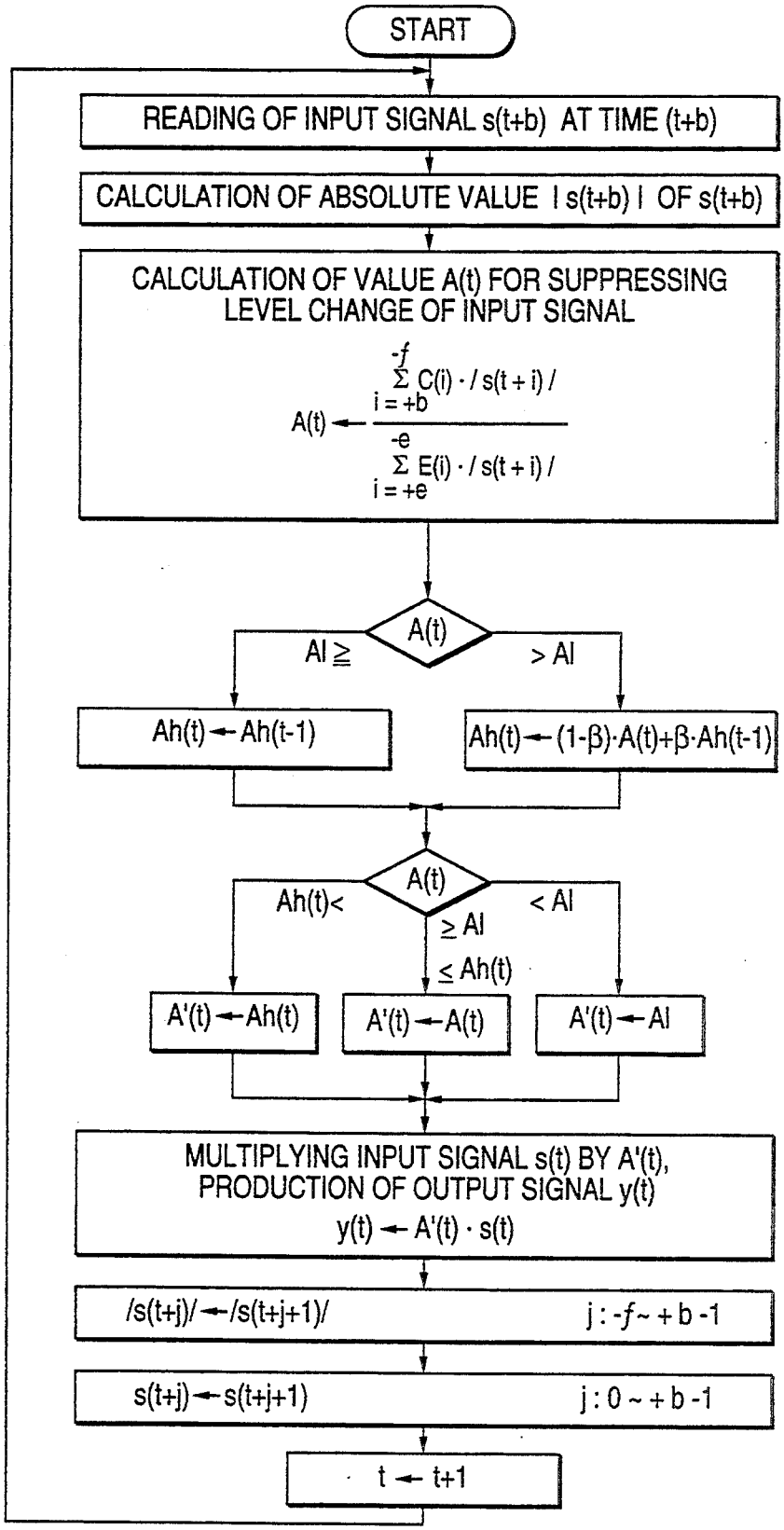
FIG. 14 is a flow chart of a method for speech signal processing in the second embodiment of the invention.

FIG. 14 is a flow chart of a method for speech signal processing in the second embodiment of the invention. Its operation is described below.

First input signal s(t+b) at time t+b is read in. Next the absolute value $|s(t+b)|$ of the input signal s(t+b) is determined. According to equation (13), equation (14) or equation (15), the value A(t) for suppressing the change of level of the input signal is obtained. C(i) in equation (13) is what is shown in equation (1), C(i) in equation (14) is what is shown in equation (4), and C(i) in equation (15) is what is shown in equation (7), and E(i) is what is shown in equation (10). In conformity with equation (17), the upper limit value Ah(t) of nonlinear processing is determined.

$$Ah(t) = \beta \cdot Ah(t-1) + (1-\beta) \cdot A(t) \ldots \text{if } A(t) > A1 \qquad (17)$$

$$Ah(t) = Ah(t-1) \ldots \text{if } A(t) < A1$$

$$0 \leqq \beta \leqq 1$$

Then, in equation (18), the value A'(t) after nonlinear processing of A(t) is obtained.

$$A'(t) = Ah(t) \ldots \text{if } A(t) > Ah(t)$$

$$A'(t) = A(t) \ldots \text{if } Ah(t) \geqq A(t) \geqq A1$$

$$A'(t) = A1 \ldots \text{if } A1 > A(t) \qquad (18)$$

Next, as shown in equation (19), the input signal s(t) is multiplied by A'(t), and the output signal y(t) is obtained.

$$y(t) = A'(t) \cdot s(t) \qquad (19)$$

The absolute value of the input signal is then shifted by one sample each. Consequently, the input signal is shifted by one sample each. Finally, the time t is updated, thereby returning to the first processing.

Thus, according to this embodiment, by finding the absolute value of the input signal, determining the value A(t) for suppressing the change of level of the input signal according to equation (13), equation (14) or equation (15) by using the absolute values of the input signals at time t and the time before and after it, obtaining the value A'(t) by nonlinear processing of value A(t), and multiplying the value A'(t) by the input signal s(t), the change of level of the input signal is suppressed, and therefore the signal of a small level such as a consonant is prevented from being masked by the signal of a large level such as a vowel, thereby improving the intelligibility, and moreover since the value A(t) corresponds to the change of the level of input signal, the stationary noise in the silent section will not be amplified. By nonlinear processing, the value A(t) becomes value A'(t) defined with the upper limit and lower limit, and hence excessive enhancement or suppression may be prevented, so that the speech may be enhanced without sacrificing the natural sound of the speech. Furthermore, since the upper limit value Ah(t) of the nonlinear processing is obtained adaptively by smoothing the value A(t), the upper limit value Ah(t) becomes small in a noisy environment, and excessive amplification of noise is prevented, while the result A'(t) of nonlinear processing is likely to be saturated at the upper limit value, and the stationary gain section is extended, and the naturalness of the speech is hardly spoiled.

In the embodiment, the upper limit value Ah(t) of nonlinear processing is varied adaptively, but it may be a fixed constant as shown in equation (20). In this case, the quantity of calculations is decreased.

$$A'(t)=Ah \text{ ... if } A(t)>Ah$$

$$A'(t)=A(t) \text{ ... if } Ah\geqq A(t)\geqq Al$$

$$A'(t)=Al \text{ ... if } Al>A(t) \qquad (20)$$

Figure 15:
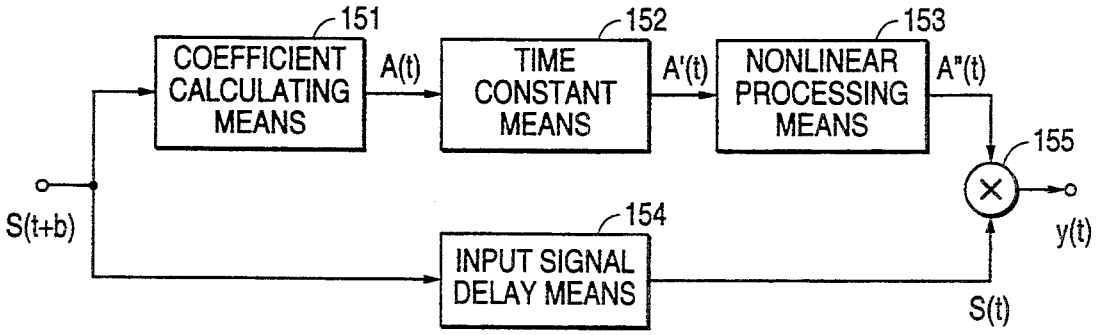
FIG. 15 is a structural diagram of an apparatus for speech signal processing in a third embodiment of the invention.

FIG. 15 shows the constitution of an apparatus for speech signal processing in a third embodiment of the invention. In FIG. 15, numeral 151 is coefficient calculating means, 152 is time constant means, 153 is nonlinear processing means, 154 is input signal delay means, and 155 is first multiplying means. The coefficient calculating means 151 is the same as that shown in FIG. 2.

In thus composed apparatus for speech signal processing is described below.

First the coefficient calculating means 151 and input signal delay means 154 receive an input signal s(t+b). Then the coefficient calculating means 151 determines the value A(t) for suppressing the change of level of the input signal s(t) on the basis of the input signals at that time t and the time before and after it. Next the time constant means 152 obtains the value A'(t) having the time constant applied to the output A(t) of the coefficient calculating means 151. The nonlinear processing means 153 performs nonlinear processing on the output A'(t) of the time constant means 152 and delivers the value A''(t). The input signal delay means 154 delays the input signal by the time b required for processing. The first multiplying means 155 multiplies and produces the output s(t) of the input signal delay means 154 and the output A''(t) of the nonlinear processing means 153. Finally the input signal delay means 154 delays all the stored content by one sample each.

Figure 16:
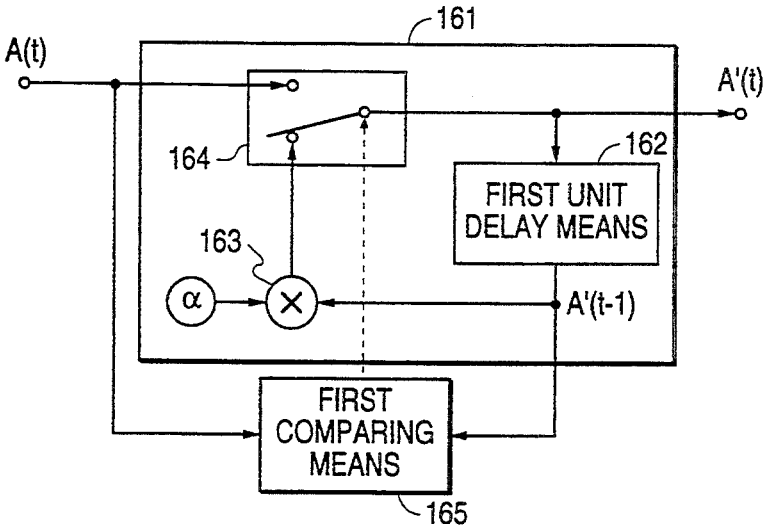
FIG. 16 is a structural diagram of time constant means of the apparatus for speech signal processing in the third embodiment of the invention.

FIG. 16 shows the constitution of the time constant means 152 of the apparatus for speech signal processing in the third embodiment of the invention. In FIG. 16, numeral 161 is first smoothing means, 162 is first unit delay means for delaying the output A'(t) of the time constant means by one sample, 163 is second multiplying means for multiplying the output of the first unit delay means 162 by coefficient $\alpha(0<\alpha<1)$, 164 is first changeover means for selecting the output of the coefficient calculating means 151 and the output of the second multiplying means 163, and 165 is first comparing means for comparing the output of the coefficient calculating means 151 and the output of the first unit delay means 162, and controlling the first changeover means 164.

The operation of the thus composed time constant means of the apparatus for speech signal processing, is described below.

First, the first unit delay means 162 delays the output A'(t) of the first changeover means 164 by one sample. Next, the second multiplying means 163 multiplies the output A'(t−1) of the first unit delay means 162 by the coefficient $\alpha(0<\alpha<1)$. The first comparing means 165 compares the output A(t) of the coefficient calculating means 151 and the output A'(t−1) of the first unit delay means 162, and controls so that the first changeover means 164 may select the output A'(t) of the coefficient calculating means 151 when the output A(t) of the coefficient calculating means 151 is larger than the output A'(t−1) of the first unit delay means 162, and control so that the first changeover means 164 may select the output $\alpha$.A'(t−1) of the second multiplying means 163 when the output A'(t−1) of the first unit delay means 162 is larger than the output A(t) of the coefficient calculating means 151.

Figure 17:
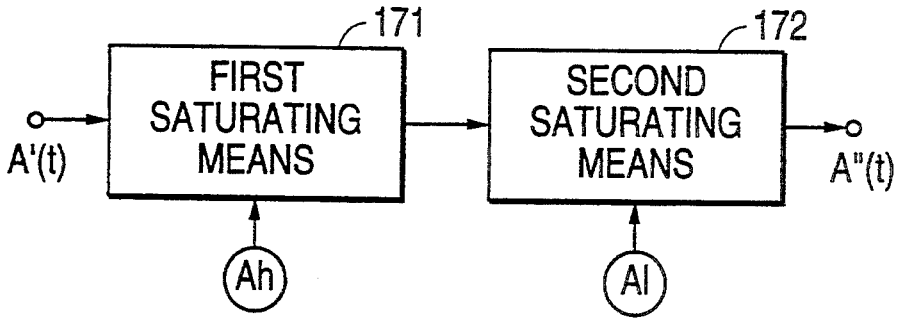
FIG. 17 is a structural diagram of nonlinear processing means of the apparatus for speech signal processing in the third embodiment of the invention.

FIG. 17 shows the constitution of the nonlinear processing means 153 of the apparatus for speech signal processing in the third embodiment of the invention. In FIG. 17, numeral 171 is first saturating means for saturating when the output value A'(t) of the time constant means 152 exceeds the upper limit, and 172 is second saturating means for saturating when the value A'(t) becomes slower than the lower limit. This constitution is same as that shown in FIG. 10, except that the input is changed from the output of the coefficient calculating means 151 to the output of the time constant means 152.

The operation of the thus composed nonlinear processing means of the apparatus for speech signal processing, its operation is described below.

The first saturating means 171 saturates the value A'(t) to the upper limit value Ah when the output value A'(t) of the time constant means 152 exceeds the upper limit value Ah. The second saturating means 172 saturates the value A'(t) to the lower limit value Al when the value A'(t) does not exceed the lower limit value Al, and produces the value A''(t) for suppressing the change of level of the input signal.

Figure 18:
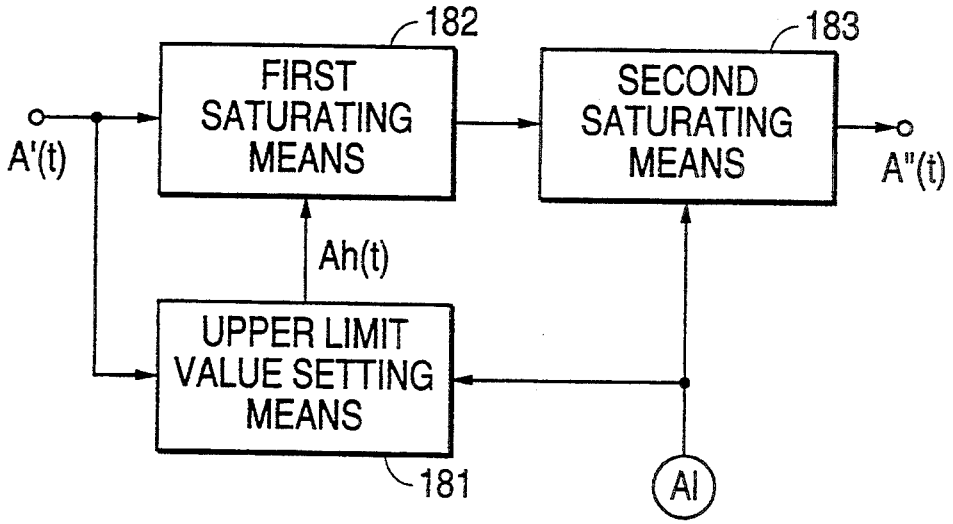
FIG. 18 is another structural diagram of nonlinear processing means of the apparatus for speech signal processing in the third embodiment of the invention.

FIG. 18 shows another constitution of the nonlinear processing means 153 of the apparatus for speech signal processing in the third embodiment of the invention. In FIG. 18, numeral 181 denotes upper limit setting means for producing the upper limit value, 182 is first saturating means for saturating when the output value A'(t) of the time constant means 152 exceeds the upper limit, and 183 is second saturating means for saturating when the value A'(t) becomes lower than the lower limit. This constitution is same as that shown in FIG. 12, except that the input is changed from the coefficient calculating means 151 to the time constant means 152.

The operation of the thus composed nonlinear processing means of the apparatus for speech signal processing is described below.

The upper limit setting means 181 produces the upper limit value Ah(t) on the basis of the output value A'(t) of the time constant means 152 and the lower limit value Al. The first saturating means 182 saturates the value A'(t) to the upper limit value Ah(t) when the value A'(t) exceeds the upper limit value Ah(t) produced by the upper limit setting means 181. The second saturating means 183 saturates the value A'(t) to the lower limit value Al when the value A'(t) does not exceed the lower limit value Al, thereby producing the value A''(t) for suppressing the change of level of the input signal.

Figure 19:
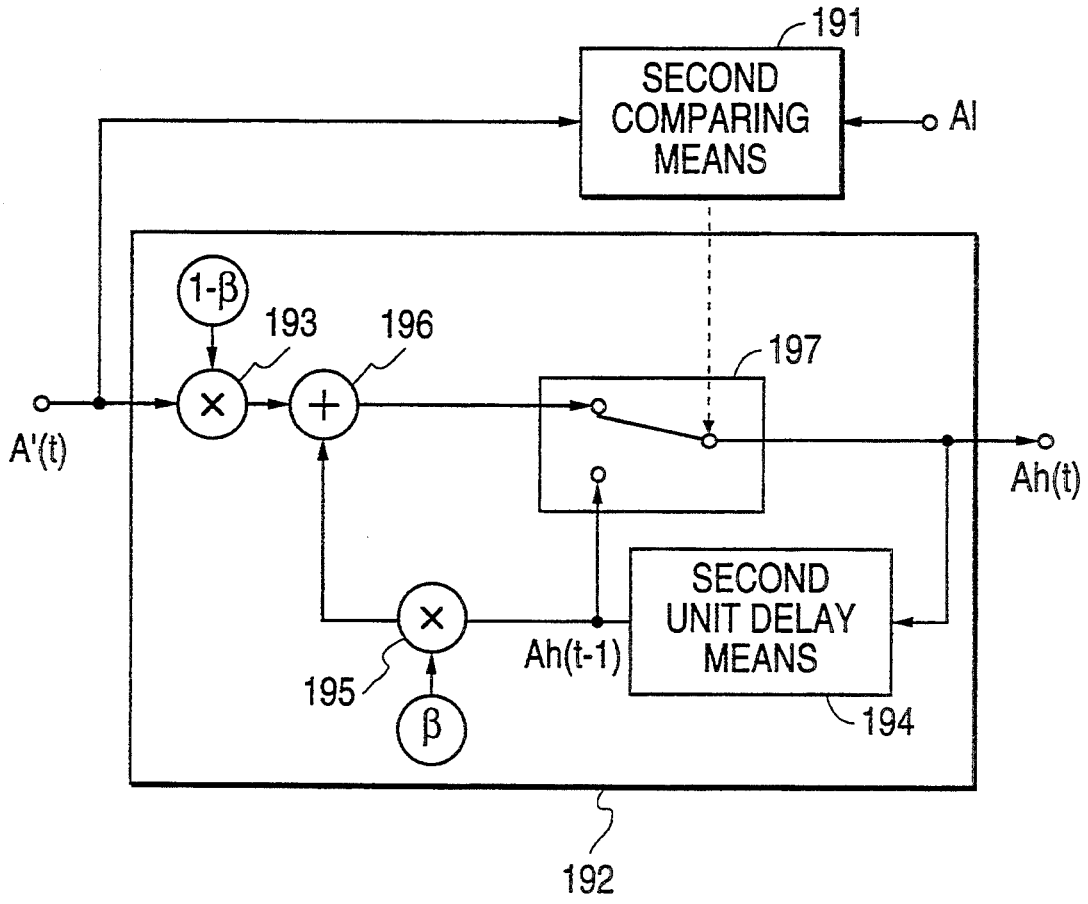
FIG. 19 is a structural diagram of upper limit value setting means of the nonlinear processing means of the apparatus for speech signal processing in the third embodiment of the invention.

FIG. 19 shows the constitution of the upper limit setting means 181 of the apparatus for speech signal processing in the third embodiment of the invention. In FIG. 19, numeral 191 denotes second comparing means for comparing the output value A'(t) of the time constant means 152 and the lower limit value Al, 192 is second smoothing means for smoothing the value A'(t), 193 is third multiplying means for multiplying $(1-\beta)$ to the output value A'(t) of the time constant means 152, 194 is the second unit delay means for forming unit delay on the output of the second smoothing means 192, 195 is fourth multiplying means for multiplying coefficient $\beta(0 \leqq \beta \leqq 1)$ to the output of the second unit delay means 194, 196 is adding means for summing up the output of the third multiplying means 193 and the output of the fourth multiplying means 195, and 197 is second changeover means for selecting the output of the second unit delay means 194 and the output of the adding means 196. This constitution is the same as that shown in FIG. 13, except that the input is changed from the coefficient calculating means 151 to the time constant means 152.

The operation of the thus composed upper limit value setting means of the apparatus for speech signal processing is described below.

The second comparing means 191 compares the output value A'(t) of the time constant means 152 and the value Al set as the lower limit. When the second comparing means 191 judges that the output of the time constant means 152 is greater than the value Al set as the lower limit, the second comparing means 191 changes over the second changeover means 197 to the upper side, and the third multiplying means 193, second unit delay means 194, fourth multiplying means 195, and adding means 196 smooth the output of the time constant means 152, thereby producing the upper limit value Ah(t). On the other hand, if the second comparing means 191 judges that the output of the time constant means 152 is smaller than the value Al set as the lower limit, the second comparing means 191 changes over the second changeover means 197 to the lower side, and the output of the second unit delay means 194 is produced as the upper limit value Ah(t), and this value is maintained.

Thus, according to the embodiment, the coefficient calculating means 151 determines the value A(t) for suppressing the change of the level of input signal on the basis of the input signals at that time and the time before and after it, and the value A''(t) after the time constant means 152 and the nonlinear processing means 153 is multiplied by the output s(t) of the input signal delay means 154 by the first multiplying means 155 to produce the product, and therefore the change of level of the output signal is suppressed as compared with the input signal, and the signal of a small level such as a consonant is prevented from being masked by the signal of a large level such as a vowel, so that the intelligibility may be improved, and moreover the time constant means 152 produces the value A'(t) applying the time constant to the fall of the output A(t) of the coefficient calculating means 151, so that the amplifying section is extended backward, and not only the consonant but also the transitional part from the consonant to the vowel may be enhanced, and the intelligibility is further improved, while the nonlinear processing means 153 performs nonlinear processing on the value A'(t) to deliver the value A''(t) defined with upper limit and lower limit, and therefore excessive enhancement or suppression may be avoided, and the speech may be hence enhanced without sacrificing natural sound of the speech. Further, the coefficient calculating means 151 produces the value A(t) corresponding to the level change of the input signal, and the stationary noise in the silent section is not amplified, and moreover the value A(t) becomes large when the level before and after the time t is larger than the level at the time t, and becomes small when the level before and after the time t is smaller than the level at the time t, so that the level change of the input signal may be easily and stably suppressed. In addition, the upper limit setting means 181 of the nonlinear processing means 153 smoothes the output A'(t) of the time constant means 152 and determines the upper limit value Ah(t) adaptively, and therefore the upper limit value Ah(t) becomes small in a noisy environment, and excessive amplification of noise is prevented, and the output A''(t) of the nonlinear processing means 153 is likely to be saturated with the upper limit, and the stationary gain section is extended, and the naturalness of the speech is hardly spoiled.

Figure 20:
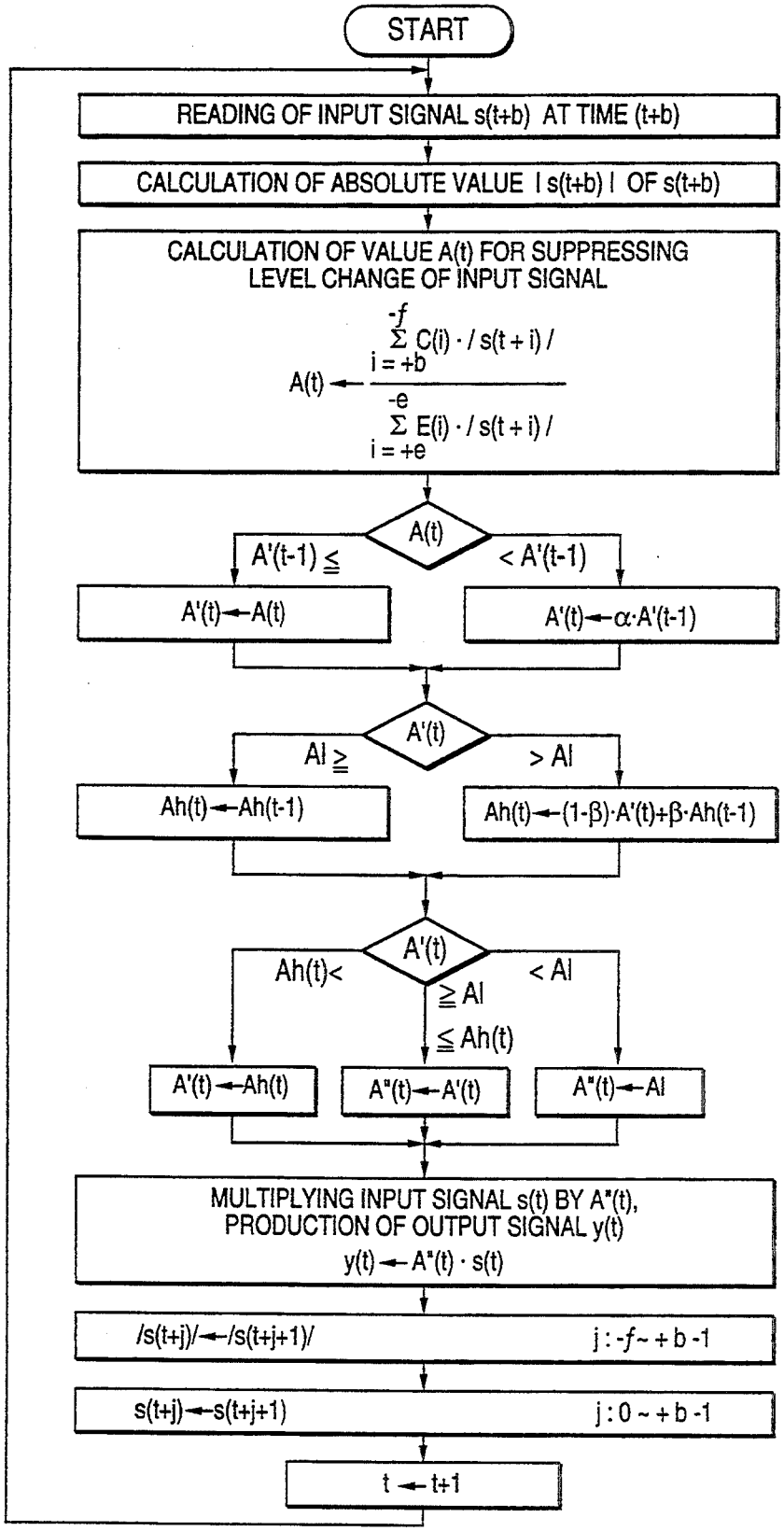
FIG. 20 is a flow chart of a method for speech signal processing in the third embodiment of the invention.

FIG. 20 is a flow chart of a method for speech signal processing in the third embodiment of the invention.

Its operation is described below.

First input signal s(t+b) at time t+b is read in. Then the absolute value s(t+b) of the input signal s(t+b) is determined. According to equation (13), equation (14) or equation (15), the value A(t) for suppressing the change of level of the input signal is determined. C(i) in equation (13) is what is shown in equation (1), Ci in equation (14) is what is shown in equation (4), and C(i) in equation (15) is what is shown in equation (7), and E(i) is what is shown in equation (10). In equation (21), the value A'(t) of applying the time constant to A(t) is determined.

$$A'(t)=A(t) \ldots \text{ if } A'(t-1) \leqq A(t)$$

$$A'(t)=\alpha \cdot A'(t-1) \ldots \text{ if } A'(t-1) > A(t)$$

$$\text{where } 0<\alpha<1 \tag{21}$$

In equation (22), the upper limit value Ah(t) of nonlinear processing is obtained.

$$Ah(t) = \beta \cdot Ah(t-1) + (1-\beta) \cdot A'(t) \ldots \text{ if } A'(t) > A1 \tag{22}$$

$$Ah(t) = Ah(t-1) \ldots \text{ if } A'(t) \leqq A1$$

$$0 \leqq \beta \leqq 1$$

Then in equation (23), the value A''(t) applying nonlinear processing to A'(t) is obtained.

$$A''(t)=Ah(t) \ldots \text{ if } A'(t) > Ah(t)$$

$$A''(t)-A'(t) \ldots \text{ if } Ah(t) \geqq A'(t) \geqq Al$$

$$A''(t)=Al \ldots \text{ if } Al > A'(t) \tag{23}$$

As shown in equation (24), the input signal s(t) is multiplied by A''(t), and the output signal y(t) is obtained.

$$y(t)=A''(t) \cdot s(t) \tag{24}$$

The absolute value of input signal is shifted by one sample each. Next the input signal is shifted by one sample each. Finally, the time t is updated to return to the initial processing.

Thus, according to the embodiment, by determining the absolute value of input signal, obtaining the value A(t) for suppressing the change of the level of input signal according to equation (13), equation (14) or equation (15) by using the absolute values of the input signals at that time t and the time before and after it, applying time constant processing on the value A(t) to obtain the value A'(t), applying nonlinear processing on the value A'(t) to obtain the value A''(t), and multiplying the value A''(t) by the input signal s(t), the change of level of the input signal is suppressed, and the signal of a small level such as a consonant is prevented from being masked by the signal of a large level such as a vowel, thereby improving the intelligibility, and moreover since the value A(t) corresponds to the change of level of the input signal, stationary noise in the silent section will not be amplified. By the time constant processing, the value A(t) is the value A'(t) applying the time constant upon fall, and the amplifying section is extended backward, and not only the consonant but also the transitional part from consonant to vowel may be enhanced, so that the intelligibility is further improved in addition, by nonlinear processing, the value A'(t) becomes the value A''(t) defined with the upper limit and lower limit, and excessive enhancement or suppression may be avoided, and the speech may be enhanced without sacrificing the natural sound of the speech. Still further, by finding the upper limit value Ah(t) of nonlinear processing adaptively by smoothing A'(t) which is the result of time constant processing, the upper limit value Ah(t) becomes smaller in a noisy environment, and excessive amplification of noise is prevented, and the result of nonlinear processing, A''(t), it likely to be saturated at the upper limit, and therefore the stationary gain section is extended, so that the naturalness of the speech may be hardly spoiled.

this embodiment, meanwhile, the upper limit value Ah(t) of nonlinear processing is varied adaptively, but it may be a fixed constant as shown in equation (25). In this case, the quantity of calculations is decreased.

$$A''(t)=Ah \text{ ... if } A'(t)>Ah$$

$$A''(t)=A'(t) \text{ ... if } Ah \geqq A'(t) \geqq Al$$

$$A''(t)=Al \text{ ... } Al>A'(t) \qquad (25)$$

What is claimed is:

1. An apparatus for converting an input speech signal to a signal-level-change-suppressed output speech signal, comprising:

input means for receiving the input speech signal;

suppressing means for suppressing a signal level change of the input speech signal, said suppressing means comprising: coefficient calculating means for determining a value for suppressing a change of a level of the input speech signal; input signal delay means for delaying the input speech signal to compensate for a processing delay; and multiplying means for multiplying an output of the input signal delay means by an output of the coefficient calculating means to thereby obtain the signal-level-change-suppressed speech signal; and output means for outputting the signal-level-change-suppressed speech signal, wherein the coefficient calculating means comprises:

absolute value means for obtaining successive absolute values of the input speech signal in a predetermined period of time;

absolute value delay means for storing and delaying the successive absolute values obtained by the absolute value means;

first memory means for storing coefficients for calculating the value for suppressing the change of the level of the input speech signal;

second memory means for storing coefficients for calculating the level of the input speech signal;

first convolution operating means for performing a convolution operation of contents of the absolute value delay means and the first memory means;

second convolution operating means for performing a convolution operation of the contents of the absolute value delay means and contents of the second memory means; and dividing means for dividing a convolution operation result of the first convolution operating means by a convolution operation result of the second convolution operating means to thereby obtain the value for suppressing the change of the level of the input speech signal.

2. An apparatus of claim 1, wherein the first memory means stores, as the coefficients for calculating the value for suppressing the change of the level of the input speech signal, a characteristic for making a central part concave with respect to a peripheral part of a time axis of the contents of the absolute value delay means.

3. An apparatus of claim 1, wherein the first memory means stores, as the coefficients for calculating the value for suppressing the change of the level of the input speech signal, a characteristic for differentiating the contents of the absolute value delay means in two steps with respect to a time axis.

4. An apparatus of claim 1, wherein the first memory means stores, as the coefficients for calculating the value for suppressing the change of of the level of the input speech signal, coefficients C(t) expressed in the following equation:

$$C(t)=ke\cdot\exp(-t^2/2\sigma e^2)-ki\cdot\exp(-t^2/2\sigma i^2)$$

where t is a sampling point of the input speech signal, and ke, ki, $\sigma$e and $\sigma$i are constants satisfying conditions of ke<ki, $\sigma$e<$\sigma$i.

5. An apparatus of claim 1, wherein the first memory means stores, as the coefficients for calculating the value for suppressing the change of the level of the input speech signal, coefficients C(t) expressed in the following equation:

$$C(t)=\text{kef}\cdot\exp(-t^2/2\sigma ef^2)-\text{kif}\cdot\exp(-t^2/2\sigma if^2) \qquad t\leqq 0$$

$$C(t)=\text{keb}\cdot\exp(-t^2/2\sigma eb^2)-\text{kib}\cdot\exp(-t^2/2\sigma ib^2) \qquad t>0$$

where t is a sampling point of the input speech signal, and kef, kif, keb, $\sigma$ef, $\sigma$if, $\sigma$eb and $\sigma$ib are constants satisfying conditions of kef<kif, $\sigma$ef>$\sigma$if keb<kib, $\sigma$eb>$\sigma$ib kef<keb, kif<kib $\sigma$ef>$\sigma$eb, $\sigma$if>$\sigma$ib.

6. An apparatus of claim 1, wherein the first memory means store, as the coefficients for calculating the value for suppressing the change of the level of the input speech signal, coefficients C(t) expressed in the following equation:

$$C(t)=0 \qquad t<0$$

$$C(t)=\mathrm{ke}\cdot\exp(-t^2/2\sigma e^2)-\mathrm{ki}\cdot\exp(-t^2/2\sigma i^2) \qquad t\geqq 0$$

where t is a sampling point of the input speech signal, and ke, ki, $\sigma$e and $\sigma$i are constants satisfying conditions of ke<ki, $\sigma$e>$\sigma$i.

7. An apparatus of claim 1, wherein the second memory means store, as the coefficients for calculating the level of the input speech signal, a characteristic for gradually decreasing a peripheral part with respect to a central part of a time axis of the contents of the absolute value delay means.

8. An apparatus of claim 1, wherein the second memory means store, as the coefficients for calculating the level of the input speech signal, a characteristic for integrating the contents of the absolute value delay means with respect to a time axis.

9. An apparatus of claim 1, wherein the second memory means stores, as the coefficients for calculating the level of the input speech signal, coefficients E(t) expressed in the following equation:

$$E(t)=\mathrm{ke}\cdot\exp(-t^2/2\sigma n^2)$$

where t is a sampling point of the input speech signal, and kn and $\sigma$n are constants.

10. A method for converting an input speech signal s(t) to a signal-level-change,suppressed output speech signal, comprising the steps of:

receiving the input speech signal;

obtaining successive absolute values of the input speech signal in a predetermined period of time;

calculating a value A(t) for suppressing a change of a level of the input speech signal at a sampling point t on the basis of information of the absolute values of the input speech signal at sampling point t and sampling points before and after sampling point t;

multiplying the input speech signal by the value A(t) to thereby obtain a signal-level-change suppressed output speech signal; and outputting the signal-level-change-suppressed output speech signal, wherein the step of calculating the value A(t) comprises the steps of:

performing a first convolution operation of coefficients C(t) for calculating the value. A(t) and the successive absolute values to obtain a first convolution operation result;

performing a second convolution operation of coefficients E(t) for calculating the level of the input speech signal and the successive absolute values to obtain a second convolution operation result; and dividing the first convolution operation result by the second convolution operation result to thereby obtain the value A(t).

11. A method of claim 10, wherein the value A(t) is calculated in the following equation:

$$A(t)=\frac{\sum_{i=+b}^{-b} C(i)\cdot|s(t+i)|}{\sum_{i=+e}^{-e} E(i)\cdot|s(t+i)|}$$

$$C(t)=\mathrm{ke}\cdot\exp(-t^2/2\sigma e^2)-\mathrm{ki}\cdot\exp(-t^2/2\sigma i^2)$$

where ke, ki, $\sigma$e and $\sigma$i are constants satisfying conditions of ke<ki, $\sigma$e>$\sigma$i $$E(t)=\mathrm{kn}\cdot\exp(-t^2/2\sigma n^2)$$

where kn and $\sigma$n are constants.

12. A method of claim 10, wherein the value A(t) is calculated in the following equation:

$$A(t)=\frac{\sum_{i=+b}^{-f} C(i)\cdot|s(t+i)|}{\sum_{i=+e}^{-e} E(i)\cdot|s(t+i)|}$$

$$C(t)=\mathrm{kef}\cdot\exp(-t^2/2\sigma e^2)-\mathrm{kif}\cdot\exp(-t^2/2\sigma ij^2) \qquad t\leqq 0$$

$$C(t)=\mathrm{keb}\cdot\exp(-t^2/2\sigma eb^2)-\mathrm{kib}\cdot\exp(-t^2/2\sigma ib^2) \qquad t>0$$

where kef, kif, keb, kib., $\sigma$ef, $\sigma$eb and $\sigma$ib are constants satisfying conditions of kef<kif, $\sigma$ef>$\sigma$if keb<kib, $\sigma$eb>$\sigma$ib kef<keb, kif<kib $\sigma$ef>$\sigma$eb, $\sigma$if>$\sigma$ib $$E(t)=\mathrm{kn}\cdot\exp(-t^2/2\sigma n^2)$$

where kn and $\sigma$n are constants.

13. A method of claim 10, wherein the value A(t) is calculated in the following equation:

$$A(t)=\frac{\sum_{i=+b}^{0} C(i)\cdot|s(t+i)|}{\sum_{i=+e}^{-e} E(i)\cdot|s(t+i)|}$$

$$C(t)=0 \qquad t<0$$

$$C(t)=\mathrm{ke}\cdot\exp(-t^2/2\sigma e^2)-\mathrm{ki}\cdot\exp(-t^2/2\sigma i^2) \qquad t\geqq 0$$

where ke, ki, $\sigma$e and $\sigma$i are constants satisfying conditions of ke<ki, $\sigma$e>$\sigma$i $$E(t)=\mathrm{kn}\cdot\exp(-t^2/2\sigma n^2)$$

where kn and $\sigma$n are constants.

14. An apparatus for converting an input speech signal to a signal-level-change-suppressed output speech signal, comprising:

input means for receiving the input speech signal;

suppressing means for suppressing a signal level change of the input speech signal to obtain the signal-level-change-suppressed output speech signal; and output means for outputting the signal-level-change-suppressed speech signal, wherein said suppressing means comprises:

coefficient calculating means for determining a value for suppressing a change of a level of the input speech signal;

nonlinear processing means for performing a nonlinear processing on an output of the coefficient calculating means;

input signal delay means for delaying the input speech signal to compensate for a processing delay; and multiplying means for multiplying an output of the input signal delay means by an output of the nonlinear processing means to thereby obtain the signal-level-change-suppressed speech signal; and wherein the coefficient calculating means comprises:

absolute value means for obtaining successive absolute values of the input speech signal in a predetermined period of time;

absolute value delay means for storing and delaying the successive absolute values obtained by the absolute value means;

first memory means for storing coefficients for calculating the value for suppressing the change of the level of the input speech signal;

second memory means for storing coefficients for calculating the level of the input speech signal;

first convolution operating means for performing a convolution operation of contents of the absolute value delay means and the first memory means;

second convolution operating means for performing a convolution operation of the contents of the absolute value delay means and contents of the second memory means; and dividing means for dividing a convolution operation result of the first convolution operating means by a convolution operation result of the second convolution operating means to thereby obtain the value for suppressing the change of the level of the input speech signal.

15. An apparatus of claim 14, wherein the nonlinear processing means comprises:

first saturating means for saturating the output of the coefficient calculating means to an upper limit value when the output of the coefficient calculating means is larger than the upper limit value; and second saturating means for saturating the output of the coefficient calculating means to a lower limit value when the output of the coefficient calculating means is smaller than the lower limit value.

16. An apparatus of claim 14, wherein the nonlinear processing means comprises:

upper limit value setting means for setting an upper limit value on the basis of the output of the coefficient calculating means;

first saturating means for saturating the output of the coefficient calculating means to an upper limit value when the output of the coefficient calculating means is larger than the upper limit value set by the upper limit value setting means; and second saturating means for saturating the output of the coefficient calculating means to a lower limit value when the output of the coefficient calculating means is smaller than the lower limit value.

17. An apparatus of claim 14, wherein the upper limit value setting means comprises:

comparing means for comparing the output of the coefficient calculating means and the lower limit value; and smoothing means for smoothing the output of the coefficient calculating means when the comparing means judges that the output of the coefficient calculating means is larger than the lower limit value, and for retaining a previously set upper limit value of the upper limit value setting means when the comparing means judges that the output of the coefficient calculating means is smaller than the lower limit value.

18. A method for converting an input speech signal s(t) to a signal-level-change-suppressed output speech signal, comprising the steps of:

receiving the input speech signal;

obtaining successive absolute values of the input speech signal in a predetermined period of time;

calculating a value A(t) for suppressing a change of a level of the input speech signal at a sampling point t on the basis of information of the absolute values of the input speech signal at sampling point t and sampling points before and after sampling point t;

performing a nonlinear processing on the value A(t) to obtain a nonlinearly processed value A'(t);

multiplying the input speech signal by the nonlinearly processed value A'(t) to thereby obtain the signal-level-change-suppressed output speech signal; and outputting the signal-level-change-suppressed output speech signal, wherein the step of calculating the value A(t) comprises the steps of:

performing a first convolution operation of coefficients for calculating the value A(t) and the successive absolute values to obtain a first convolution operation result;

performing a second convolution operation of coefficients for calculating the level of the input speech signal and the successive absolute values to obtain a second convolution operation result; and dividing the first convolution operation result by the second convolution operation result to thereby obtain the value A(t).

19. A method of claim 18, wherein the nonlinear processing is conducted in accordance with the following formula:

$$A'(t)=Ah \text{ ... if } A(t)>Ah$$

$$A'(t)=A(t) \text{ ... if } Ah \geqq A(t) \geqq Al$$

$$A'(t)=Al \text{ ... if } Al>A(t)$$

where Ah and Al are constants satisfying a condition of Ah>Al.

20. A method of claim 18, wherein the nonlinear processing is conducted in accordance with the following formula:

$$A'(t)=Ah \text{ ... if } A(t)>Ah(t)$$

$$A'(t)=A(t) \text{ ... if } Ah(t) \geqq A(t) \geqq Al$$

$$A'(t)=Al \text{ ... if } Al>A(t)$$

where $$Ah(t)=\beta \cdot Ah(t-1)+(1-\beta) \cdot A(t) \text{ ... if } A(t)>Al$$

$$Ah(t)=Ah(t-1) \text{ ... if } A(t) \leqq Al$$

$0 \leqq \beta \leqq 1$, and Al is a constant.

21. An apparatus for converting an input speech signal to a signal-level-change-suppressed output speech signal, comprising:

input means for receiving the input speech signal;

suppressing means for suppressing a signal level change of the input speech signal to obtain the signal-level-change-suppressed speech signal; and output means for outputting the signal-level-change-suppressed speech signal, wherein said suppressing means comprises:

coefficient calculating means for determining a value for suppressing a change of a level of the input speech signal;

time constant means for applying a time constant to an output of the coefficient calculating means;

nonlinear processing means for performing a nonlinear processing on an output of the time constant means;

input signal delay means for delaying the input speech signal to compensate for a processing delay; and multiplying means for multiplying an output of the input signal delay means by an output of the nonlinear processing means to thereby obtain the signal-level-change-suppressed speech signal; and wherein the coefficient calculating means comprises:

absolute value means for obtaining successive absolute values of the input speech signal in a predetermined period of time;

absolute value delay means for storing and delaying the successive absolute values obtained by the absolute value means;

first memory means for storing coefficients for calculating the value for suppressing the change of the level of the input speech signal;

second memory means for storing coefficients for calculating the level of the input speech signal;

first convolution operating means for performing a convolution operation of contents of the absolute value delay means and the first memory means;

second convolution operating means for performing a convolution operation of the contents of the absolute value delay means and contents of the second memory means; and dividing means for dividing a convolution operation result of the first convolution operating means by a convolution operation result of the second convolution operating means to thereby obtain the value for suppressing the change of the level of the input speech signal.

22. An apparatus of claim 21, wherein the time constant means comprises:

comparing means for comparing the output of the coefficient calculating means and a previous output of the time constant means; and smoothing means for using the output of the coefficient calculating means as the output of the time constant means when the comparing means judges that the output of the coefficient calculating means is larger than the previous output of the time constant means, and for smoothing the previous output of the time constant means to use as the output of the time constant means when the comparing means judges that the previous output of the time constant means is larger than the output of the coefficient calculating means.

23. An apparatus of claim 21, wherein the time constant means comprises:

unit delay means for delaying the output of the time constant means by one sample;

comparing means for comparing the output of the coefficient calculating means and an output of the unit delay means;

second multiplying means for multiplying the output of the unit delay means by a coefficient $\alpha$ ($0<\alpha 1$); and changeover means for using the output of the coefficient calculating means as the output of the time constant means when the comparing means judges that the output of the coefficient calculating means is larger than the output of the unit delay means, and for using an output of the second multiplying means as the output of the time constant means when the comparing means judges that the output of the unit delay means is larger than the output of the coefficient calculating means.

24. An apparatus of claim 21, wherein the nonlinear processing means comprises:

first saturating means for saturating the output of the time constant means to an upper limit value when the output of the time constant means is larger than the a upper limit value; and second saturating means for saturating the output of the time constant means to a lower limit value when the output of the time constant means is smaller than the lower limit value.

25. An apparatus of claim 21, wherein the nonlinear processing means comprises:

upper limit value setting means for setting an upper limit value on the basis of the output of the time constant means;

first saturating means for saturating the output of the time constant means to the upper limit value when the output of the time constant means is larger than the upper limit value set by the upper limit value setting means; and second saturating means for saturating the output of the time constant means to a lower limit value when the output of the time constant means is smaller than the lower limit value.

26. An apparatus of claim 25, wherein the upper limit value setting means comprises:

comparing means for comparing the output of the time constant means and the lower limit value; and smoothing means for smoothing the output of the time constant means when the comparing means judges that the output of the time constant means is larger than the lower limit value, and for retaining a previously set upper limit value of the upper limit value setting means when the comparing means judges that the output of the coefficient calculating means is smaller than the lower limit value.

27. A method for converting an input speech signal to an output signal-level-change-suppressed speech signal, comprising the steps of:

receiving the input speech signal;

obtaining successive absolute values of the input speech signal in a predetermined period of time;

calculating a value A(t) for suppressing a change of a level of the input speech signal at a sampling point t on the basis of information of the absolute values of the input speech signal at sampling point t and sampling points before and after sampling point t;

performing a time constant processing on the value A(t) to obtain a time constant processing result A'(t);

performing a nonlinear processing on the time constant processing result A'(t) to obtain a nonlinear processing result A''(t);

multiplying the input speech signal by the nonlinearly processing result A''(t) to thereby obtain the signal-level-change suppressed speech signal; and outputting the signal-level-change-suppressed speech signal, wherein the step of calculating the value A(t) comprises the steps of:

performing a first convolution operation of coefficients for calculating the value A(t) and the successive absolute values to obtain a first convolution operation result;

performing a second convolution operation of coefficients for calculating the level of the input speech signal and the successive absolute values to obtain a second convolution operation result; and dividing the first convolution operation result by the second convolution operation result to thereby obtain the value A(t).

28. A method of claim 27, wherein the time constant processing is performed in accordance with the following equation:

$$A'(t)=A(t) \text{ ... if } A'(t-1)\leqq A(t)$$

$$A'(t)=\alpha\cdot A'(t-1) \text{ ... if } A'(t-1)>A(t)$$

where $\alpha$ is a constant satisfying a condition of $0<\alpha<1$.

29. A method of claim 27, wherein the nonlinear processing is conducted in accordance with the following formula:

$$A''(t)=Ah \text{ ... if } A(t)>Ah$$

$$A''(t)=A'(t) \text{ ... if } Ah\geqq A'(t)\geqq Al$$

$$A''(t)=Al \text{ ... if } Al>A'(t)$$

where Ah and Al are constants satisfying a condition of Ah>Al.

30. A method of claim 27, wherein the nonlinear processing is conducted in accordance with the following formula:

$$A''(t)=Ah(t) \text{ ... if } A'(t)>Ah(t)$$

$$A''(t)=A'(t) \text{ ... if } Ah(t)\geqq A'(t)\geqq Al$$

$$A''(t)=Al \text{ ... if } Al>A'(t)$$

where $$Ah(t)=\beta\cdot Ah(t-1)+(1-\beta)\cdot A'(t) \text{ ... if } A'(t)>A1$$

$$Ah(t)=Ah(t-1) \text{ ... if } A'(t)\leqq Al$$

$0\leqq\beta 1$, and Al is a constant.

* * * * *